US010746411B2

(12) United States Patent
Ham et al.

(10) Patent No.: US 10,746,411 B2
(45) Date of Patent: Aug. 18, 2020

(54) COOKING APPARATUS

(71) Applicant: Samsung Electronics Co., Ltd, Gyeonggi-do (KR)

(72) Inventors: Hyung Kwen Ham, Seoul (KR); Hyeon Kyu Lim, Suwon-si (KR); Nam Soo Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 203 days.

(21) Appl. No.: 15/881,361

(22) Filed: Jan. 26, 2018

(65) Prior Publication Data

US 2018/0209659 A1 Jul. 26, 2018

(30) Foreign Application Priority Data

Jan. 26, 2017 (KR) ..... 10-2017-0012359

(51) Int. Cl.
*F24C 15/02* (2006.01)
*E05B 47/00* (2006.01)
(Continued)

(52) U.S. Cl.
CPC ..... *F24C 15/022* (2013.01)

(58) Field of Classification Search
CPC ..... F24C 15/022; E05B 2015/0235; E05B 2047/0069; E05C 3/26; H05B 6/6417
See application file for complete search history.

(56) References Cited

U.S. PATENT DOCUMENTS 3,831,580 A * 8/1974 McLean ..... E05C 5/00 126/197
4,163,443 A * 8/1979 Peterson ..... E05C 5/00 126/197
(Continued)

FOREIGN PATENT DOCUMENTS

DE 19504574 C2 * 5/2002 ..... F24C 15/022
EP 1249191 A2 * 10/2002 ..... A47B 88/467
(Continued)

OTHER PUBLICATIONS

ISA/KR, International Search Report for International Application No. PCT/KR2018/001099, dated May 23, 2018, 4 pages.

*Primary Examiner* — Jorge A Pereiro
*Assistant Examiner* — Logan P Jones

(57) ABSTRACT

Disclosed herein is a cooking apparatus capable of accurately perceiving whether a door is closed. Disclosed herein is also a cooking apparatus capable of preventing a latch assembly of a main body from being pressurized by another object outside the cooking apparatus in a state in which a door is opened. The cooking apparatus includes a latch assembly disposed in a main body and configured to confine a key member of a door, wherein the latch assembly includes: a body including an interference hole therein; a first lever rotatably coupled to the body; a second lever configured to be rotatable in a first direction due to pressurization of the key member; a stopper connected to the second lever and configured to restrict rotation of the first lever as the stopper is inserted into the interference hole; and a sensor configured to be selectively pressurized by the first lever and sense whether the door is opened and closed to prevent malfunction of the cooking apparatus.

19 Claims, 7 Drawing Sheets

(51) Int. Cl.

| | |
|---|---|
| ***E05C 3/26*** | (2006.01) |
| ***H05B 6/64*** | (2006.01) |
| ***E05B 15/02*** | (2006.01) |

(56) References Cited

U.S. PATENT DOCUMENTS 4,497,513 A * 2/1985 Sasaki ..... E05C 19/02 292/217
4,509,779 A 4/1985 Sasaki
4,745,250 A * 5/1988 Mayo ..... H01H 3/163 200/50.1
4,858,969 A * 8/1989 Lee ..... E05C 19/024 292/78
5,300,745 A * 4/1994 Chartrain ..... H05B 6/6417 126/197
5,517,006 A 5/1996 Fredriksson et al.
5,580,138 A * 12/1996 Grabher ..... A47B 88/467 312/319.1
7,091,458 B2 8/2006 Lee et al.
7,956,304 B2 * 6/2011 Bacigalupe ..... H01H 9/226 200/334
9,370,294 B2 * 6/2016 Osvatic ..... A47L 15/4259
2005/0248163 A1 11/2005 Kim
2007/0278919 A1 * 12/2007 Lu ..... A47B 88/467 312/333
2011/0095019 A1 4/2011 Davies

FOREIGN PATENT DOCUMENTS

EP 1336357 A1 * 8/2003 ..... A47B 88/467
EP 1571891 A1 9/2005
GB 1534771 A * 12/1978 ..... E05C 3/24
KR 2002-0072158 A 9/2002
KR 20-0416692 Y1 5/2006
KR 10-2011-0044034 A 4/2011
WO WO-2007080146 A2 * 7/2007 ..... E05B 17/0029

* cited by examiner

COOKING APPARATUS

CROSS-REFERENCE TO RELATED APPLICATION

This application is related to and claims priority to Korean Patent Application No. 10-2017-0012359 filed on Jan. 26, 2017, the disclosure of which is incorporated herein by reference.

TECHNICAL FIELD

Embodiments of the present disclosure relate to a cooking apparatus having an improved structure for fixing a door.

BACKGROUND

A cooking apparatus is an apparatus for cooking food. An oven is an example of a cooking apparatus.

An oven is a device for cooking food and includes a cooking chamber, a heating device for heating the cooking chamber, and a circulating device for circulating heat generated in the heating device inside of the cooking chamber. Ovens, which are mechanisms for sealing, heating, and cooking an object to be cooked, can be classified into an electric oven, a gas oven, and a microwave oven according to a heat source thereof. The electric oven uses an electric heater as a heat source, and the gas oven and the microwave oven use heat caused by a gas being combusted and frictional heat of water molecules caused by high frequency waves as a heat source, respectively.

The microwave oven is a cooking apparatus for heating food using characteristics of electronic waves called microwaves. Through a dielectric heating method, the microwave oven generates heat inside of food to heat the food. When electronic waves having high frequency collide with the food, water molecules inside the food are rotated, and thus a molecular arrangement of the food is disordered. The microwave oven heats the food using heat generated when the water molecules are rotated.

In order to prevent microwaves, which are harmful to a human body, from leaking when the microwave oven operates in a state in which a door is open, the microwave oven should operate in a state in which the door is fully closed. A sensor for sensing whether the door is closed may be provided in a main body of the microwave oven. For example, when a switch provided in the sensor is pressurized, it may be determined that the door is closed, and the microwave oven may operate.

SUMMARY

To address the above-discussed deficiencies, it is a primary object to provide a cooking apparatus capable of accurately perceiving whether a door is closed.

It is another aspect of the present disclosure to provide a cooking apparatus capable of preventing a latch assembly of a main body from being pressurized by another object outside the cooking apparatus in a state in which a door is opened.

Additional aspects of the disclosure will be set forth in part in the description which follows and, in part, will be obvious from the description, or may be learned by practice of the disclosure.

In accordance with one aspect of the present disclosure, a cooking apparatus includes a latch assembly disposed in a main body and configured to confine a key member of a door, wherein the latch assembly includes: a body including an interference hole therein; a first lever rotatably coupled to the body; a second lever configured to be rotatable in a first direction due to pressurization of the key member; a stopper connected to the second lever and configured to restrict rotation of the first lever as the stopper is inserted into the interference hole; and a sensor selectively pressurized by the first lever and configured to sense whether the door is opened or closed to prevent a malfunction of the cooking apparatus.

The stopper may be configured to leave the interference hole as the second lever is rotated in the first direction.

The second lever may include a guide protrusion, and the stopper may include a guide groove into which the guide protrusion is inserted.

The guide groove may extend to be inclined with respect to a direction of a rotation shaft of the second lever.

When the second lever is rotated, the stopper may move in the same direction as a rotation shaft of the second lever.

The second lever may include a lever portion pressurized by the key member when the key member is inserted into the latch assembly.

As the second lever is rotated in the first direction and pressurizes one portion of the first lever, the first lever may be rotated in the first direction together with the second lever.

The latch assembly may further include a first elastic member having one end connected to the first lever and the other end opposite the one end connected to the second lever, and the first elastic member may apply an elastic force to the second lever in a manner that the second lever is rotated with respect to the first lever in a second direction opposite the first direction.

The cooking apparatus may further include a pressurizing member disposed at one side of the first lever to be pressurized by the first lever, wherein, when the pressurizing member is pressurized by the first lever, one side of the pressurizing member may pressurize a switch disposed in the sensor.

The pressurizing member may include a pressurizing protrusion, and the first lever may pressurize the pressurizing protrusion when the first lever is rotated in the first direction.

The pressurizing member may release a pressurized state of the switch disposed in the sensor when the first lever is rotated to pass through the pressurizing protrusion.

The latch assembly may further include a second elastic member having one end connected to the first lever, the second elastic member may apply an elastic force to the first lever in a second direction opposite the first direction when opening of the door starts, and the second elastic member may apply an elastic force to the first lever in the first direction when the opening of door ends.

The latch assembly may further include a third elastic member having one end connected to the second elastic member, and the third elastic member may apply an elastic force to the second elastic member in a direction in which the key member is inserted into the latch assembly. The body may be mounted on the main body and may include a rotation shaft on which the first lever and the second lever are mounted.

The first lever may include a hook portion, the key member may include a fixing hole, and when the key member is inserted into the latch assembly, the hook portion may be inserted into the fixing hole.

In accordance with another aspect of the present disclosure, a cooking apparatus includes a latch assembly configured to confine a door not to be opened, wherein the latch assembly includes: a first lever having a hook portion therein configured to confine a key member disposed on the door; a second lever configured to be rotatable in a first direction together with the first lever due to an external force; and a stopper configured to selectively interfere with rotation of the first lever, and wherein the stopper releases interference with respect to the first lever as the second lever is rotated.

The cooking apparatus may further include a sensor configured to be selectively pressurized by the first lever and configured to sense that the door is closed when the sensor is pressurized by the first lever.

The second lever may include a guide protrusion configured to guide movement of the stopper, and the stopper may include a guide groove into which the guide protrusion is inserted and through which the guide protrusion is moved.

The latch assembly may further include a first elastic member configured to apply an elastic force to the second lever in a manner that the second lever is rotated with respect to the first lever in a second direction opposite the first direction, and the first elastic member may apply an elastic force to the first lever and the second lever in a manner that the second lever and the first lever are sequentially rotated due to an external force.

The latch assembly may further include a second elastic member having one end mounted on the first lever and configured to apply an elastic force in a manner that the first lever is rotated in a second direction opposite to the first direction and returns to its original position when an external force for rotating the first lever in the first direction is removed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or vith, have, have a property of, or the like.

Definitions for certain words and phrases are provided throughout this patent document those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, a cooking apparatus according to an embodiment will be described in detail with reference to the attached drawings.

Figure 1:
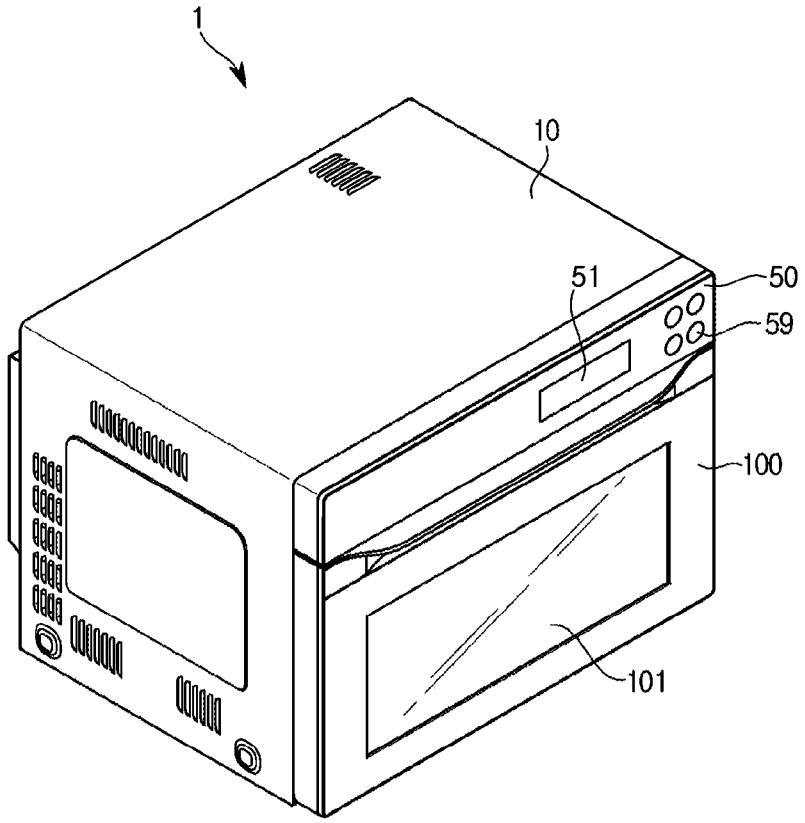
FIG. 1 is a perspective view of a cooking apparatus according to an embodiment.
Figure 2:
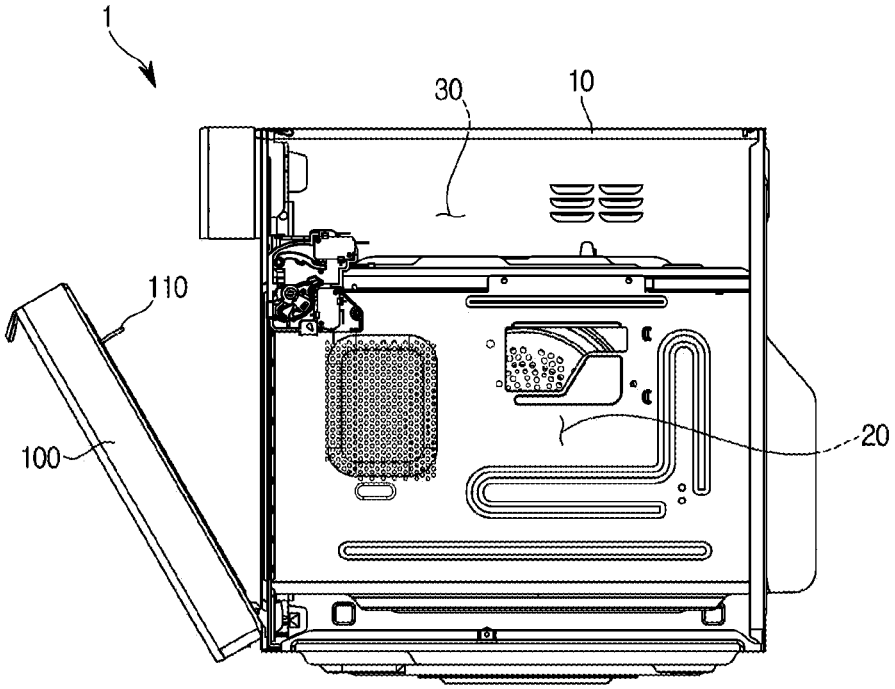
FIG. 2 is a side view of the cooking apparatus according to an embodiment.

FIG. 1 is a perspective view of a cooking apparatus according to an embodiment, and FIG. 2 is a side view of the cooking apparatus according to an embodiment.

Referring to FIGS. 1 and 2, a cooking apparatus 1 includes a main body 10 that constitutes an exterior thereof and a cooking chamber 20 having a space in which food is cooked inside the main body 10. Hereinafter, for convenience of explanation, a direction in which a door 100 is installed based on the cooking apparatus 1 will be defined as a forward direction.

The cooking chamber 20 may be disposed inside the main body 10. The cooking chamber 20 may be spaced a predetermined distance apart from an inner side of the main body 10.

An electronic equipment chamber 30 may be formed inside the main body 10. The electronic equipment chamber 30 is provided so that electronic equipment for operating the cooking apparatus 1 may be installed therein. The electronic equipment chamber 30 may be provided on the cooking chamber 20 as a space formed between the cooking chamber 20 and the main body 10. The cooking chamber 20 may have an open front surface. The open front surface of the cooking chamber 20 may be opened and closed by the door 100. The door 100 may be hinge-coupled to one side of a front surface of the main body 10 to open and close the cooking chamber 20.

The door 100 may have a see-through window 101 at a front surface thereof such that the inside of the cooking chamber 20 is visible in a state in which the cooking chamber 20 is closed. A user may check a cooking procedure through the see-through window 101 disposed in the door 100 when cooking food.

The cooking chamber 20 may be formed by combining a plurality of plates. According to an embodiment, the cooking chamber 20 may include side plates that constitute sides of the cooking chamber 20, a top plate that constitutes a top surface of the cooking chamber 20, and a bottom plate that constitutes a bottom surface of the cooking chamber 20. The side plates, the top plate, and the bottom plate may be combined by welding. Alternatively, the side plates, the top plate, and the bottom plate may also be combined by screw coupling. Also, the cooking chamber 20 may be formed by one plate being bent.

A control panel 50 may be installed at an upper portion of the front surface of the cooking apparatus 1. The control panel 50 may operate electronic equipment disposed in the electronic equipment chamber 30.

The control panel 50 may include an input unit 59 and a display unit 51. The input unit 59 may be provided so that the user may input instructions relating to operations, such as a cooking function, a cooking mode, and a cooking time of the cooking apparatus 1 through the input unit 59. According to an embodiment, the input unit 59 may include a plurality of switches through which the user may select the cooking mode. The plurality of switches of the input unit 59 may be provided in a touch sensing manner. The display unit 51 may display conditions and operating states set by the user using characters, numbers, and symbols.

The door 100 may be hinge-coupled to the main body 10 and be opened and closed. For example, a bottom end of the door 100 and a bottom end of the front the main body 10 may be combined using a hinge (not shown). Fixing devices 40 and 110 may be provided at the other side of the door 100 to fix the door 100 in a closed state. When the hinge is provided at the bottom ends of the door 100 and the main body 10, the fixing devices 40 and 110 may be provided at top ends of the door 100 and the main body 10.

The fixing devices 40 and 110 include a key member 110 disposed at the door 100 and a latch assembly 40 disposed in the main body 10 to fix the key member 110. The key member 110 may be disposed at a top end of an inner side of the door 100, and the latch assembly 40 may be located at a top end of the front of the main body 10 to correspond to the position of the key member 110. The installation positions of the latch assembly 40 and the key member 110 are not limited to those described above.

The latch assembly 40 may include sensors 61 and 62 configured to sense whether the door 100 is closed. The cooking apparatus 1 according to an embodiment of the present disclosure may operate only when the sensors 61 and 62 sense that the door 100 is normally closed. That is, the cooking apparatus 1 is provided not to operate when it is sensed that the door 100 is not normally closed. Thus, the cooking apparatus 1 may be prevented from malfunctioning.

In detail, when the door 100 is closed and the key member 110 pressurizes the latch assembly 40, the door 100 being normally closed may be sensed by switches (see 610 and 620 of FIG. 4) provided in the sensors 61 and 62 being pressurized by the latch assembly 40.

However, in spite of the fact that the door 100 is not closed, when another object outside the cooking apparatus 1 is inserted into the latch assembly 40 and the second lever 43 is rotated, the switches 610 and 620 of the sensors 61 and 62 may be pressurized. When the switches 610 and 620 are pressurized and it is sensed that the door 100 is closed, the cooking apparatus 1 may malfunction. In order to prevent the cooking apparatus 1 from operating in a state in which the door 100 is opened, sensing of the door 100 being closed due to the latch assembly 40 being pressurized by another object outside the cooking apparatus 1 needs to be prevented.

Figure 3:
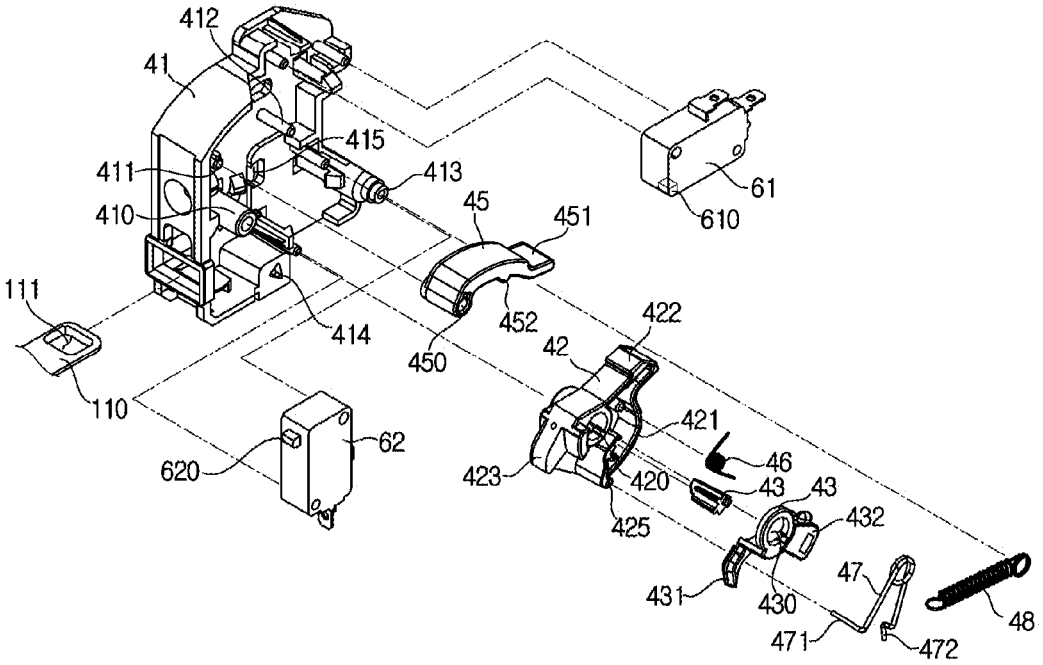
FIG. 3 is an exploded perspective view of a latch assembly of a main body and a key member of a door according to an embodiment.
Figure 4:
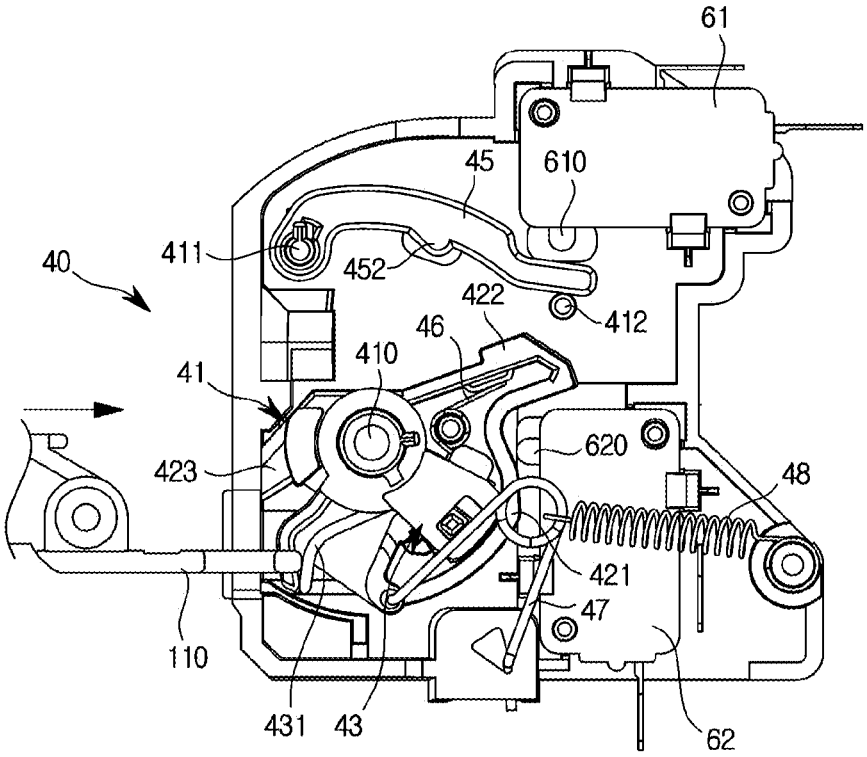
FIG. 4 is a view of a state before the latch assembly is pressurized by the key member according to an embodiment.
Figure 5:
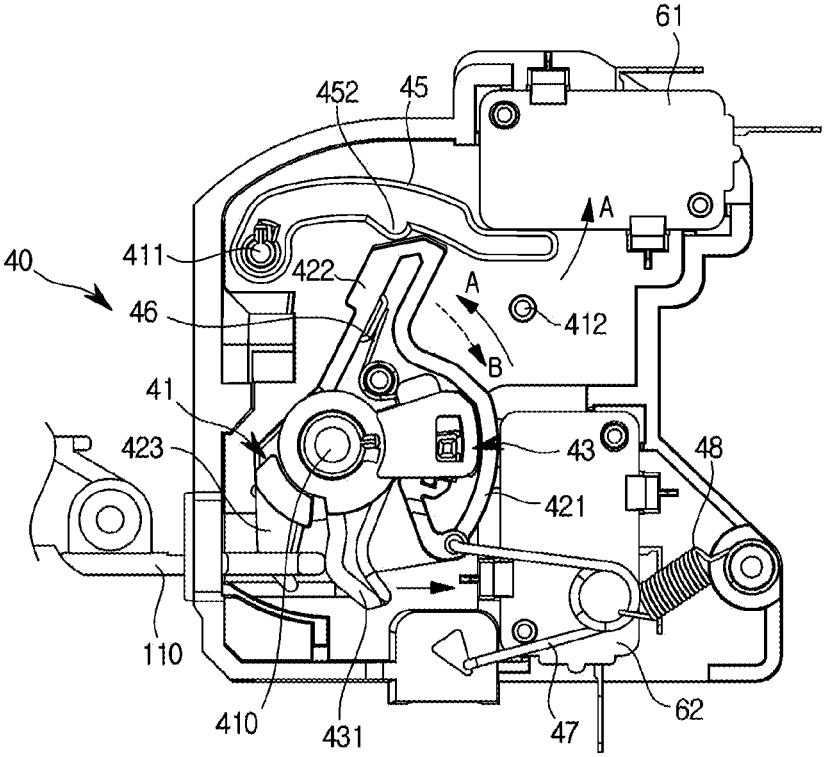
FIG. 5 is a view of a state in which the latch assembly is pressurized by the key member according to an embodiment.

FIG. 3 is an exploded perspective view of a latch assembly of a main body and a key member of a door according to an embodiment, FIG. 4 is a view of a state before the latch assembly is pressurized by the key member according to an embodiment, and FIG. 5 is a view of a state in which the latch assembly is pressurized by the key member according to an embodiment.

Referring to FIGS. 3 through 5, the latch assembly 40 according to an embodiment may include a body 41 mounted on the main body 10, and a first lever 42 and a second lever 43 rotatably mounted on the body 41. The latch assembly 40 may include a stopper 44. An interference hole 415 into which the stopper 44 is inserted may be formed in the body 41. When the stopper 44 is inserted into the interference hole 415, rotation of the first lever 42 may be limited.

A first rotation shaft 410 on which the first lever 42 and the second lever 43 are rotatably mounted may be provided on the body 41. When the door 100 is closed, the first lever 42 and the second lever 43 may be rotated around the first rotation shaft 410 in a first direction (A-direction) by the key member 110. Shaft holes 420 and 430 into which the first rotation shaft 410 is inserted may be formed in the first lever 42 and the second lever 43, respectively.

The second lever 43 may be rotated together with the first lever 42. For example, when a space in which the second lever 43 is accommodated is formed in the first lever 42 such that the second lever 43 is rotated, a portion of inner sidewalls of the first lever 42 may be pressurized by the second lever 43 such that the first lever 42 and the second lever 43 may be rotated together. In another example, protrusions that the second lever 43 interferes with may be formed in the first lever 42, and when the second lever 43 is rotated in the first direction, the first lever 42 and the second lever 43 may be rotated together due to the protrusions. A structure in which the first lever 42 and the second lever 43 are rotated together is not limited to that described above.

When the key member 110 has access to the latch assembly 40, firstly, the second lever 43 may be pressurized and rotated in the first direction. The stopper 44 may be in a locked state in which it interferes with the first lever 42, and the locked state of the stopper 44 may be released when the second lever 43 is rotated. When the locked state due to the stopper 44 is released, the first lever 42 may be rotated in the first direction together with the second lever 43.

A first sensor 61 and a second sensor 62 may be mounted on the body 41 to sense whether the door 100 is closed. A first switch 610 and a second switch 620 may be provided in the first sensor 61 and the second sensor 62, respectively, to be pressurized by the first lever 42. When the door 100 is closed, the first lever 42 may be rotated in the first direction to pressurize the first switch 610 and the second switch 620. The first sensor 61 or the second sensor 62 may not be mounted on the body 41 and may be disposed outside the body 41 to be pressurized by the first lever 42.

The first sensor 61 may be disposed on the first lever 42, and the second sensor 62 may be disposed behind the first lever. The first lever 42 may include a first pressurizing portion 422 configured to pressurize the first switch 610 provided in the first sensor 61, and a second pressurizing portion 421 configured to pressurize the second switch 620 provided in the second sensor 62.

A pressurizing member 45 may be additionally provided at an upper portion of the first lever 42. When the first switch 610 is not directly pressurized by the first lever 42 and the first lever 42 pressurizes the pressurizing member 45, the pressurizing member 45 disposed adjacent to the first sensor 61 may pressurize the first switch 610.

In detail, a protruding pressurizing protrusion 452 may be provided on the pressurizing member 45. The first lever 42 may be rotated in the first direction to pressurize the pressurizing protrusion 452. When the pressurizing protrusion 452 is pressurized, the pressurizing member 45 may be rotated in a third direction (C-direction) and pressurize the first switch 610.

In this case, when the first pressurizing portion 422 of the first lever 42 is rotated by a larger angle than a normal angle and passes through the pressurizing protrusion 452, the pressurizing member 45 may be rotated in a fourth direction again. Thus, one side 451 of the pressurizing member 45 may be spaced apart from the first sensor 61. Through this configuration, the first switch 610 of the first sensor 61 according to the present disclosure may not be excessively pressurized by the one side 451 of the pressurizing member 45.

When a pressurized state of the pressurizing member 45 is released, the pressurizing member 45 may be rotated in the fourth direction (D-direction), which is opposite the third direction, and return to its original position. In this case, a support rib 412 configured to support the pressurizing member 45 may be provided on the body 41. When the pressurizing member 45 is supported by the support rib 412 and is then pressurized by the first lever 42, the pressurizing member 45 may be rotated in the third direction and spaced apart from the support rib 412.

The one side 451 of the pressurizing member 45 may pressurize the first switch 610 of the first sensor 61. A shaft hole 450 into which a second rotation shaft 411 provided on the body 41 is inserted may be formed in the other side of the pressurizing member 45. The pressurizing member 45 may be rotatable around the second rotation shaft 411 provided on the body 41. When the first lever 42 is rotated in the first direction and pressurizes the one side of the pressurizing member 45, the pressurizing member 45 may be rotated around the second rotation shaft 411 in the third direction and pressurize the first switch 610. The pressurizing member 45 may reliably pressurize the first switch 610 at a position at which the pressurizing member 45 is adjacent to the first sensor 61.

A lever portion 431 may protrude from the second lever 43 and may be pressurized by the key member 110. Also, a guide portion 432 configured to guide movement of the stopper 44 when the first lever 42 is locked or unlocked by the stopper 44 may be provided on the second lever 43.

The latch assembly 40 may include a first elastic member 46 interposed between the first lever 42 and the second lever 43. The first elastic member 46 may provide an elastic force in a direction in which one side of the first lever 42 and one side of the second lever 43 are moved away from each other. As long as there is no external force, the one side of the first lever 42 and the one side of the second lever 43 are maintained to be spaced apart by the first elastic member 46.

That is, the elastic member 46 may include a first elastic member 46 having one end connected to the first lever 42 and the other end opposite the one end connected to the second lever 43. The first elastic member 46 may apply an elastic force to the second lever 43 in such a way that the second lever 43 may be rotated in the second direction opposite to the first direction with respect to the first lever 42.

Due to the key member 110, the second lever 43 may be pressurized in a direction opposing the direction of the elastic force of the first elastic member 46, i.e., the second direction. When the one side of the second lever 43 and the one side of the first lever 42 are in contact with each other and the second lever 43 is continuously pressurized by the key member 110, the first lever 42 and the second lever 43 may be rotated together in the first direction. When an external force caused by the key member 110 is removed, due to the elastic force of the first elastic member 46, the one side of the first lever 42 and the one side of the second lever 43 may recede from each other, and the first lever 42 and the second lever 43 may return to their original positions.

In this way, due to the key member 110, the second lever 43 and the stopper 44 may be primarily spaced a predetermined distance apart from each other so that the stopper 44, which will be described below, may be moved and release the locked state of the first lever 42. When the one side of the second lever 43 and the one side of the first lever 42 are in contact with each other in a state in which the locked state of the first lever 42 is released, the first lever 42 and the second lever 43 may be rotated together in the first direction.

A second elastic member 47 may be interposed between the first lever 42 and the body 41. One end 471 of the second elastic member 47 may be mounted on an elastic member mounting portion 425 provided on the first lever 42, and the other end 472 of the second elastic member 47 may be mounted on an elastic member mounting portion 414 provided on the body 41.

The second elastic member 47 may provide an elastic force to rotate the first lever 42 in the second direction. When the door 100 is closed, the first lever 42 may be pressurized by the second lever 43 and rotated in the first direction, and when the door 100 is opened, the first lever 42 may be rotated in the second direction due to the elastic force of the second elastic member 47 and return its original state.

In detail, the second elastic member 47 may be installed to have an elastic force in a direction in which the one end 471 and the other end 472 are moved away from each other. Thus, from a time point at which the door 100 is closed until the first lever 42 is rotated by a predetermined angle, the second elastic member 47 may apply the elastic force to the first lever 42 so that the first lever 42 may be rotated in the second direction. Subsequently, when the position of the one end 471 of the second elastic member 47 is changed as the first lever 42 is rotated, the second elastic member 47 applies the elastic force to the first lever 42 in the direction in which the one end 471 and the other end 472 are moved away from each other so that the first lever 42 may be rotated in the first direction. Thus, a user may finish an operation of closing the door 100 with a relatively small force.

A third elastic member 48 may be further provided between the second elastic member 47 and the body 41. A second mounting portion 413 on which one side of the third elastic member 48 is mounted may be provided on the body 41. The other side of the third elastic member 48 may be connected to the second elastic member 47.

The third elastic member 48 may have an elastic force in a direction in which the key member 110 is inserted into the latch assembly 40. The third elastic member 48 may provide the elastic force to the second elastic member 47 with a relatively small force so that the first lever 42 may be rotated in the first direction.

The second elastic member 47 may be provided so that the position of the one end 471 may be changed together with rotation of the first lever 42, and when the first lever 42 is rotated in the first direction by a predetermined angle, the direction of the elastic force applied to the first lever 42 may be changed.

A hook portion 423 may protrude from the first lever 42. A fixing hole 111 may be formed in the key member 110. When the door 100 is closed, the hook portion 423 may be inserted into the fixing hole 111 and fix the door 100. As long as there is no external force, the hook portion 423 does not leave the fixing hole 111, and thus the door 100 may be maintained in a closed state.

Figure 6:
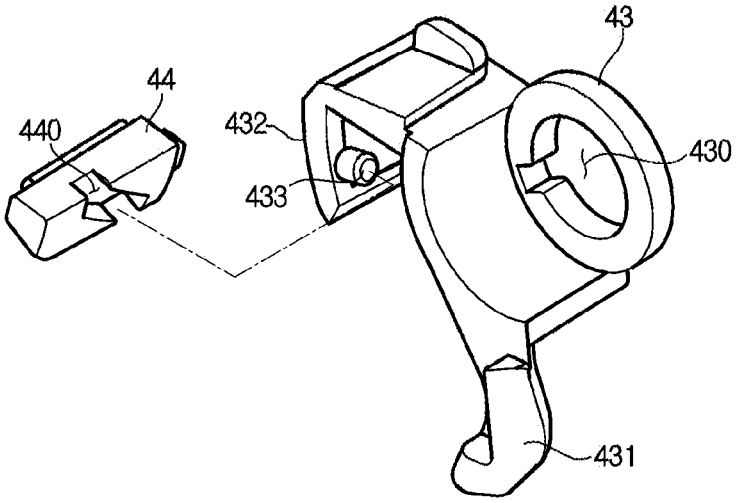
FIG. 6 is a view of a portion of the latch assembly according to an embodiment.
Figure 7:
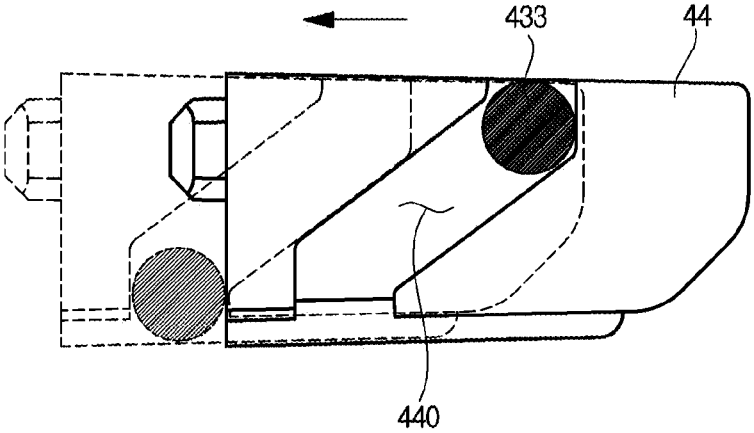
FIG. 7 is a view of a stopper of the latch assembly according to an embodiment.

FIG. 6 is a view of a portion of the latch assembly according to an embodiment, and FIG. 7 is a view of a stopper of the latch assembly according to an embodiment.

Referring to FIGS. 6 and 7, the latch assembly 40 according to an embodiment includes the stopper 44 configured to restrict rotation of the first lever 42. A guide protrusion 433 may be provided on the guide portion 432 of the second lever 43. A guide groove 440 into which the guide protrusion 433 is inserted may be formed in the stopper 44.

The guide groove 440 may extend in a forward/backward direction and may be inclined in a left/right direction. For example, the guide groove 440 may extend from a right front direction to a left rear direction.

When the second lever 43 is pressurized or a pressurized state of the second lever 43 is released, the guide protrusion 433 may move along the guide groove 440 and the stopper 44 may move to the left or to the right. Thus, an extension direction of a rotation shaft of the second lever 43 and a movement direction of the stopper 44 may be approximately the same direction. In a state in which there is no external force, the stopper 44 may interfere with the first lever 42 so that the first lever 42 may not be rotated in the first direction.

In an example, when the stopper 44 is inserted into an interference hole 415 provided in the body 41, the first lever 42 may be locked and rotation of the first lever 42 in the first direction may be limited. When the second lever 43 is pressurized, the stopper 44 may move to the right and may leave the interference hole 415. When the stopper 44 leaves the interference hole 415, the locked state of the first lever 42 may be released, and the first lever 42 may be rotated in the first direction together with the second lever 43.

In this way, in a state in which the second lever 43 is not pressurized, the stopper 44 restricts rotation of the first lever 42. In detail, when the lever portion 431 of the second lever 43 is not pressurized, the first lever 42 may not be rotated by the stopper 44, and the first switch 610 and the second switch 620 are not pressurized. Thus, it is not sensed that the door 100 is closed. Because it is not sensed that the door 100 is closed, the cooking apparatus 1 does not operate.

The lever portion 431 of the second lever 43 protrudes from a body of the second lever 43, and even when another object having a predetermined width but having a different configuration from that of the key member 110 is inserted into the latch assembly 40, it is not easy to accurately pressurize the lever portion 431. Thus, even when another object than the key member 110 is inserted into the latch assembly 40, it is not easy to release the locked state of the stopper 44. Thus, rotation of the first lever 42 in the first direction is limited by the stopper 44, and the first switch 610 and the second switch 620 provided in the first sensor 61 and the second sensor 62 are not pressurized. That is, even when another object than the key member 110 is inserted into the latch assembly 40, the second lever 43 may not be rotated. Thus, because a state in which rotation of the first lever 42 is limited by the stopper 44, is maintained, a malfunction of the cooking apparatus 1 in a state in which the door 100 is opened may be prevented.

As described above, in the cooking apparatus 1 according to an embodiment of the present disclosure, wrongly sensing the door 100 being closed due to an external object other than the key member 110 may be prevented, and the cooking apparatus 1 may be prevented from operating in a state in which the door 100 is opened. Thus, an accident that may occur when the cooking apparatus 1 operates in the state in which the door 100 is opened may be prevented.

As should be apparent from the above description, in a cooking apparatus according to an embodiment, whether a door is closed may be accurately sensed so that the cooking apparatus may operate only when the door is closed and the cooking apparatus may be prevented from malfunctioning when the door is not closed.

In addition, sensing the door being closed due to a latch assembly pressurized by another object outside the cooking apparatus in a state in which the door is opened may be prevented so that a malfunction of the cooking apparatus in a state in which the door is opened may be prevented.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A cooking apparatus comprising a latch assembly disposed in a main body and configured to confine a key member of a door, wherein the latch assembly comprises:

a body including an interference hole therein, a first lever rotatably coupled to the body, a second lever configured to be rotatable in a first direction due to pressurization of the key member, a stopper connected to the second lever and configured to restrict rotation of the first lever as the stopper is inserted into the interference hole, wherein, when the second lever is rotated, the stopper moves in the same direction as an axial direction of a rotation shaft of the second lever, and a sensor selectively pressurized by the first lever and configured to sense whether the door is opened or closed to prevent a malfunction of the cooking apparatus.

2. The cooking apparatus of claim 1, wherein the stopper is configured to leave the interference hole as the second lever is rotated in the first direction.

3. The cooking apparatus of claim 1, wherein:

the second lever comprises a guide protrusion, and the stopper comprises a guide groove into which the guide protrusion is inserted.

4. The cooking apparatus of claim 3, wherein the guide groove extends to be inclined with respect to a direction of the rotation shaft of the second lever.

5. The cooking apparatus of claim 1, wherein the second lever comprises a lever portion pressurized by the key member when the key member is inserted into the latch assembly.

6. The cooking apparatus of claim 1, wherein, as the second lever is rotated in the first direction and pressurizes one portion of the first lever, the first lever is rotated in the first direction together with the second lever.

7. The cooking apparatus of claim 6, wherein:

the latch assembly further comprises a first elastic member having one end connected to the first lever and another end opposite the one end connected to the second lever, and the first elastic member applies an elastic force to the second lever in a manner that the second lever is rotated with respect to the first lever in a second direction opposite the first direction.

8. The cooking apparatus of claim 7, further comprising a pressurizing member disposed at one side of the first lever to be pressurized by the first lever, wherein, when the pressurizing member is pressurized by the first lever, one side of the pressurizing member pressurizes a switch disposed in the sensor.

9. The cooking apparatus of claim 8, wherein:

the pressurizing member comprises a pressurizing protrusion, and the first lever pressurizes the pressurizing protrusion when the first lever is rotated in the first direction.

10. The cooking apparatus of claim 9, wherein the pressurizing member releases a pressurized state of the switch disposed in the sensor when the first lever is rotated to pass through the pressurizing protrusion.

11. The cooking apparatus of claim 1, wherein:

the latch assembly further comprises a second elastic member having one end connected to the first lever, the second elastic member applies an elastic force to the first lever in a second direction opposite the first direction when opening of the door starts, and the second elastic member applies an elastic force to the first lever in the first direction when the opening of door ends.

12. The cooking apparatus of claim 11, wherein:

the latch assembly further comprises a third elastic member having one end connected to the second elastic member, and the third elastic member applies an elastic force to the second elastic member in a direction in which the key member is inserted into the latch assembly.

13. The cooking apparatus of claim 1, wherein the body is mounted on the main body and comprises the rotation shaft on which the first lever and the second lever are mounted.

14. The cooking apparatus of claim 1, wherein:

the first lever includes a hook portion, the key member includes a fixing hole, and when the key member is inserted into the latch assembly, the hook portion is inserted into the fixing hole.

15. A cooking apparatus comprising a latch assembly configured to confine a door not to be opened, wherein the latch assembly comprises:

a first lever having a hook portion therein configured to confine a key member disposed on the door, a second lever configured to be rotatable in a first direction together with the first lever due to an external force, and a stopper configured to selectively interfere with rotation of the first lever, wherein, when the second lever is rotated, the stopper moves in the same direction as an axial direction of a rotation shaft of the second lever, and wherein the stopper releases interference with respect to the first lever as the second lever is rotated.

16. The cooking apparatus of claim 15, further comprising a sensor configured to be selectively pressurized by the first lever and sense that the door is closed when the sensor is pressurized by the first lever.

17. The cooking apparatus of claim 15, wherein:

the second lever comprises a guide protrusion configured to guide movement of the stopper, and the stopper comprises a guide groove into which the guide protrusion is inserted and through which the guide protrusion is moved.

18. The cooking apparatus of claim 15, wherein:

the latch assembly further comprises a first elastic member configured to apply an elastic force to the second lever in a manner that the second lever is rotated with respect to the first lever in a second direction opposite the first direction, and the first elastic member applies an elastic force to the first lever and the second lever in a manner that the second lever and the first lever are sequentially rotated due to an external force.

19. The cooking apparatus of claim 15, wherein the latch assembly further comprises a second elastic member having one end mounted on the first lever and configured to apply an elastic force in a manner that the first lever is rotated in a second direction opposite to the first direction and returns to its original position when an external force for rotating the first lever in the first direction is removed.

* * * * *